US005975213A

United States Patent [19]

Tripp et al.

[11] Patent Number: 5,975,213

[45] Date of Patent: Nov. 2, 1999

[54] FIRE SUPPRESSION DEVICE

[76] Inventors: Larry J. Tripp, 1453 - 17 1/2 St., Barron, Wis. 54812; Scott A. Kunkel, 1503 - 5 1/2 St., Almena, Wis. 54805

[21] Appl. No.: 09/130,092

[22] Filed: Aug. 6, 1998

[51] Int. Cl.[6] ..... A62C 8/00

[52] U.S. Cl. ..... 169/36; 169/9

[58] Field of Search ..... 169/29, 26, 36, 169/30, 91, 9, 19, 56, 54, 47; 239/70, 67, 302

[56] References Cited

U.S. PATENT DOCUMENTS

| | | | |
|---|---|---|---|
| 3,650,328 | 3/1972 | Fujiki et al. | 169/36 X |
| 3,785,569 | 1/1974 | Helmrich | 169/36 X |
| 3,833,064 | 9/1974 | Ranney, Jr. | 169/36 X |

*Primary Examiner*—Andres Kashnikow
*Assistant Examiner*—Sean P. O'Hanlon

[57] ABSTRACT

A new fire suppression device for suppressing a fire within a predetermined radius of the fire suppression device. The inventive device includes a housing having upper and lower housing portions. The housing portions are positionable between an opened position and a closed position. A tank that is disposed between the housing portions holds a flame retardant substance such as halon or a dry chemical. The outer perimeter of the tank is substantially exposed to the area outside the housing when the housing portions are in the opened position. A plurality of tubes outwardly extend from the outer perimeter of the tank. The flame retardant substance passes from the interior of the tank through the tubes when the housing portions are in the opened position.

11 Claims, 3 Drawing Sheets

FIRE SUPPRESSION DEVICE

BACKGROUND OF THE INVENTION

1. Field of the Invention

The present invention relates to fire extinguishing devices and more particularly pertains to a new fire suppression device for suppressing a fire within a predetermined radius of the fire suppression device.

2. Description of the Prior Art

The use of fire extinguishing devices is known in the prior art. More specifically, fire extinguishing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire extinguishing devices include U.S. Pat. No. 4,643,260; U.S. Pat. No. 3,993,138; U.S. Pat. No. 3,865,192; U.S. Pat. No. 5,018,586; U.S. Pat. No. 4,214,631; and U.S. Pat. No. Des. 355,862.

While these devices fulfill their respective, particular objectives and requirements, the aforementioned patents do not disclose a new fire suppression device. The inventive device includes a housing having upper and lower housing portions. The housing portions are positionable between an opened position and a closed position. A tank that is disposed between the housing portions holds a flame retardant substance such as halon or a dry chemical. The outer perimeter of the tank is substantially exposed to the area outside the housing when the housing portions are in the opened position. A plurality of tubes outwardly extend from the outer perimeter of the tank. The flame retardant substance passes from the interior of the tank through the tubes when the housing portions are in the opened position.

In these respects, the fire suppression device according to the present invention substantially departs from the conventional concepts and designs of the prior art, and in so doing provides an apparatus primarily developed for the purpose of suppressing a fire within a predetermined radius of the fire suppression device.

SUMMARY OF THE INVENTION

In view of the foregoing disadvantages inherent in the known types of fire extinguishing devices now present in the prior art, the present invention provides a new fire suppression device construction wherein the same can be utilized for suppressing a fire within a predetermined radius of the fire suppression device.

The general purpose of the present invention, which will be described subsequently in greater detail, is to provide a new fire suppression device apparatus and method which has many of the advantages of the fire extinguishing devices mentioned heretofore and many novel features that result in a new fire suppression device which is not anticipated, rendered obvious, suggested, or even implied by any of the prior art fire extinguishing devices, either alone or in any combination thereof.

To attain this, the present invention generally comprises a housing having upper and lower housing portions. The housing portions are positionable between an opened position and a closed position. A tank that is disposed between the housing portions holds a flame retardant substance such as halon or a dry chemical. The outer perimeter of the tank is substantially exposed to the area outside the housing when the housing portions are in the opened position. A plurality of tubes outwardly extend from the outer perimeter of the tank. The flame retardant substance passes from the interior of the tank through the tubes when the housing portions are in the opened position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire suppression device apparatus and method which has many of the advantages of the fire extinguishing devices mentioned heretofore and many novel features that result in a new fire suppression device which is not anticipated, rendered obvious, suggested, or even implied by any of the prior art fire extinguishing devices, either alone or in any combination thereof.

It is another object of the present invention to provide a new fire suppression device which may be easily and efficiently manufactured and marketed.

It is a further object of the present invention to provide a new fire suppression device which is of a durable and reliable construction.

An even further object of the present invention is to provide a new fire suppression device which is susceptible of a low cost of manufacture with regard to both materials and labor, and which accordingly is then susceptible of low prices of sale to the consuming public, thereby making such fire suppression device economically available to the buying public.

Still yet another object of the present invention is to provide a new fire suppression device which provides in the apparatuses and methods of the prior art some of the advantages thereof, while simultaneously overcoming some of the disadvantages normally associated therewith.

Still another object of the present invention is to provide a new fire suppression device for suppressing a fire within a predetermined radius of the fire suppression device.

Yet another object of the present invention is to provide a new fire suppression device which includes a housing having upper and lower housing portions. The housing portions are positionable between an opened position and a closed position. A tank that is disposed between the housing portions holds a flame retardant substance such as halon or a dry chemical. The outer perimeter of the tank is substantially exposed to the area outside the housing when the housing portions are in the opened position. A plurality of tubes outwardly extend from the outer perimeter of the tank. The flame retardant substance passes from the interior of the tank through the tubes when the housing portions are in the opened position.

Still yet another object of the present invention is to provide a new fire suppression device that discharges a flame retardant material in a powerful burst to knock down or put out a fire within a predetermined radius of the fire suppression device.

Even still another object of the present invention is to provide a new fire suppression device that allows a user such as a fireman to get close to or into an area without having a hose present or available.

Even still yet another object of the present invention is to provide a new fire suppression device that is portable and may be used immediately.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
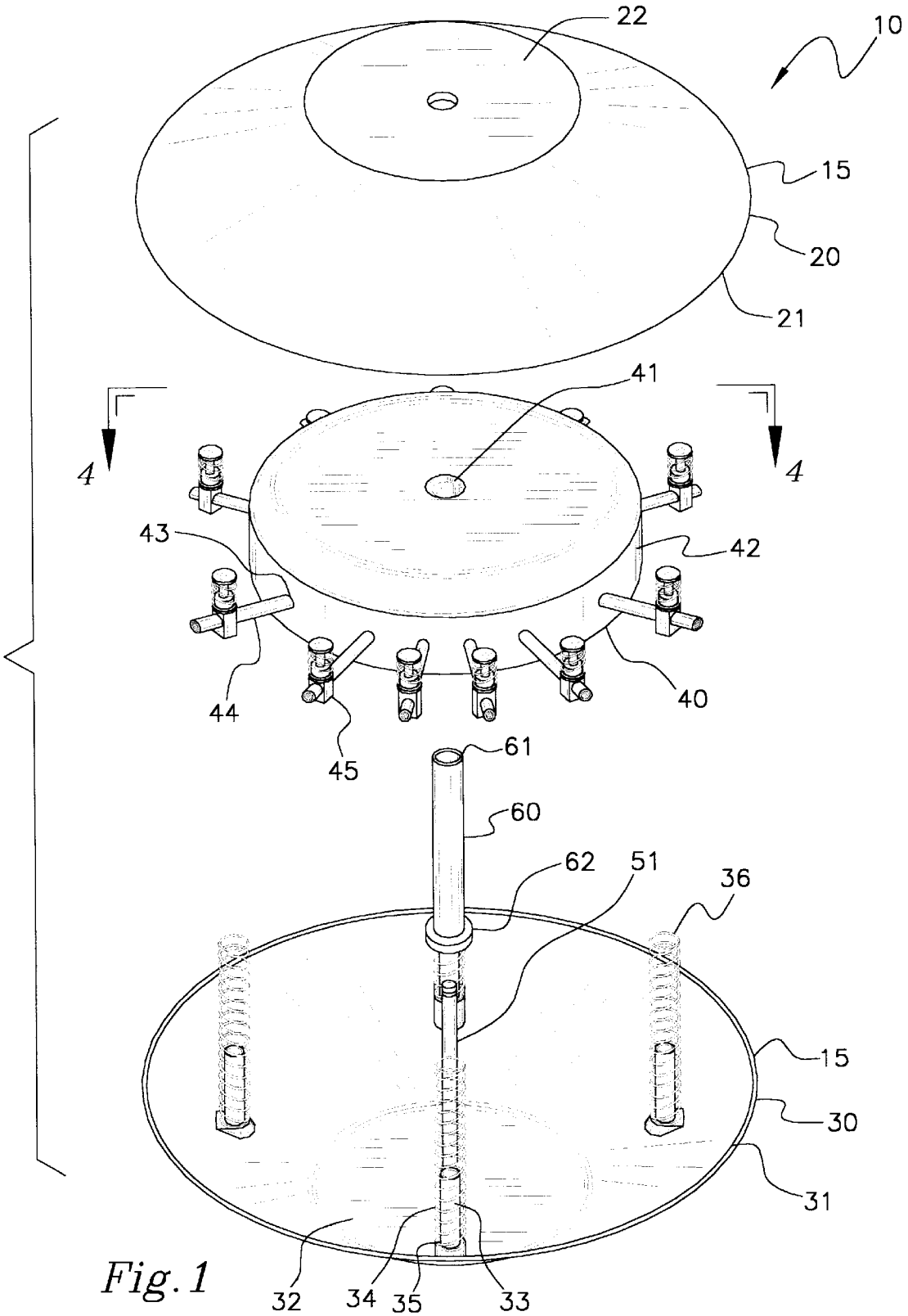
FIG. 1 is an exploded view of a new fire suppression device according to the present invention.
Figure 2:
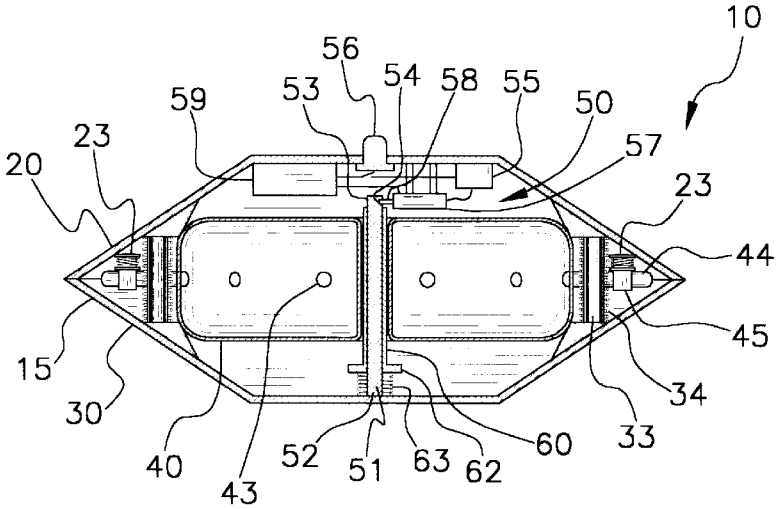
FIG. 2 is a cross-sectional view of the present invention in a closed position taken from Line 2—2 of FIG. 4.
Figure 3:
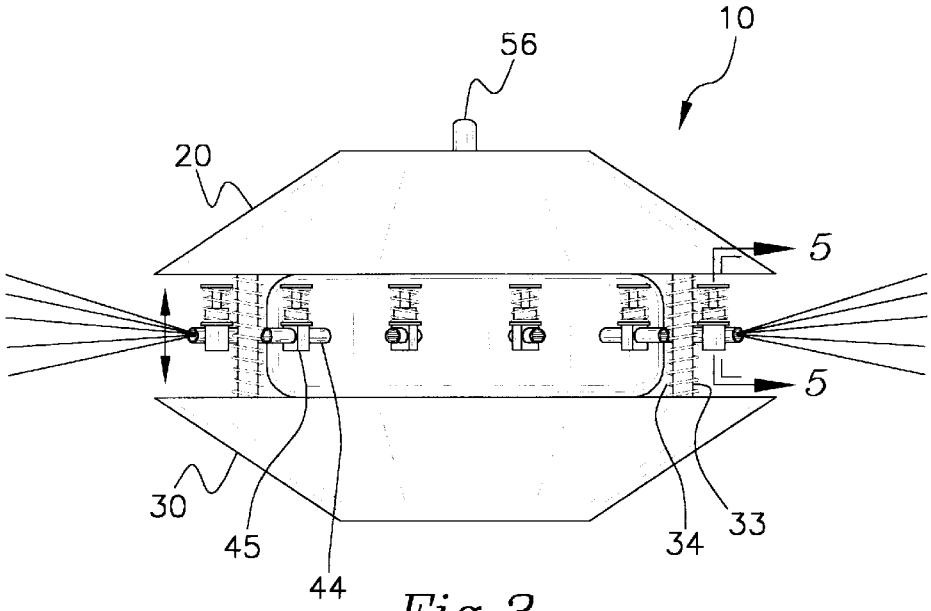
FIG. 3 is a side view of the present invention particularly illustrating the housing portions in an opened position.
Figure 4:
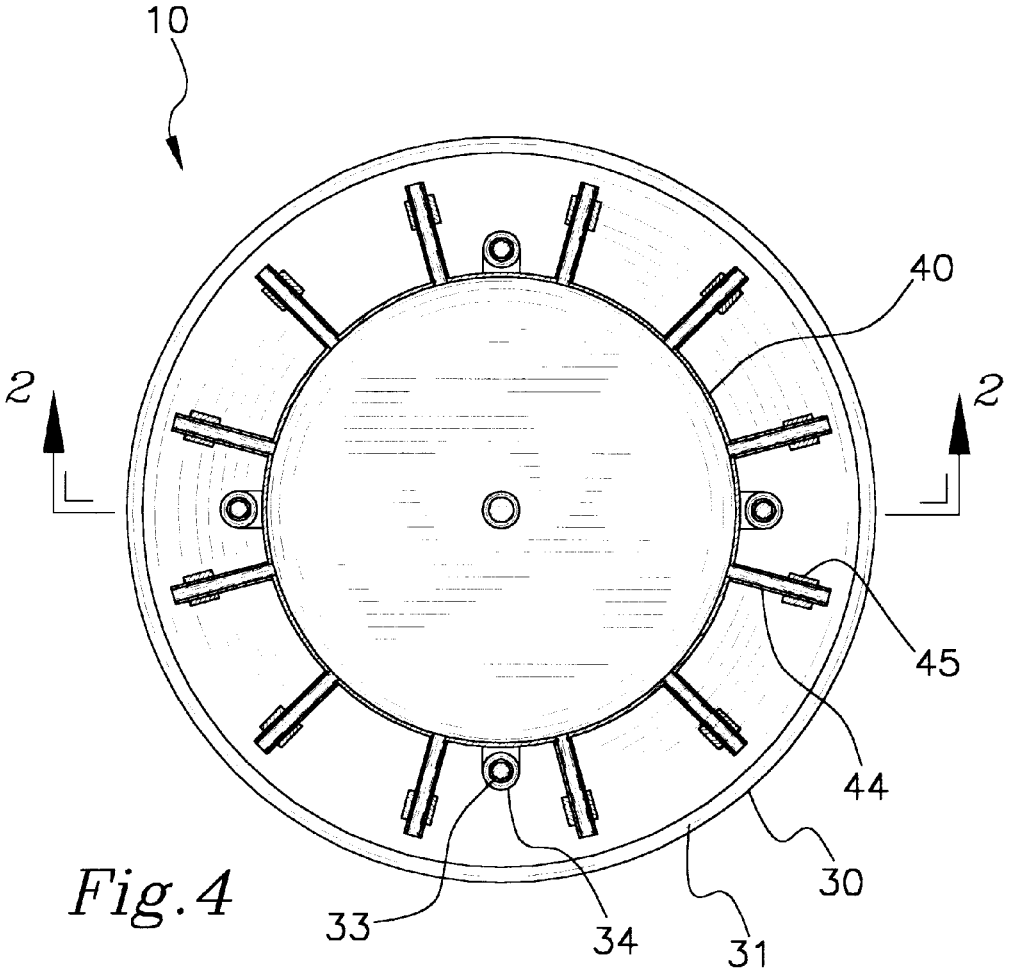
FIG. 4 is a partial side view of the present invention taken from Line 4—4 of FIG. 1.
Figure 5:
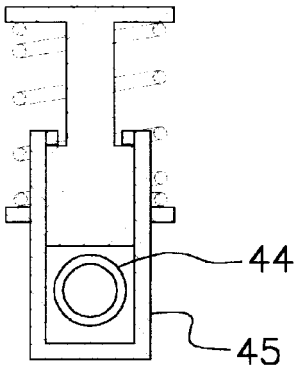
FIG. 5 is a cross-sectional view of a valve of the present invention taken from Line 5—5 of FIG. 3.

With reference now to the drawings, and in particular to FIGS. 1 through 5 thereof, a new fire suppression device embodying the principles and concepts of the present invention and generally designated by the reference numeral 10 will be described.

As best illustrated in FIGS. 1 through 5, the fire suppression device 10 comprises a housing 15 having upper and lower housing portions 20,30. The housing portions 20,30 are positionable between an opened position and a closed position. A tank 40 is disposed between the housing portions and holds a flame retardant substance such as halon or a dry chemical and may be pressurized with carbon dioxide. The outer perimeter 42 of the tank 40 is substantially exposed to the area outside the housing 15 when the housing portions 20,30 are in the opened position. A plurality of apertures 43 extend through the tank 40 into the interior of the tank 40. The apertures 43 are positioned along the outer perimeter 42 of the tank 40. The flame retardant substance passes from the interior of the tank 40 through the apertures 43 when the housing portions 20,30 are in an opened position.

Preferably, each of the apertures 43 has a tube 44 inserted therein. The tubes 44 outwardly extend from the outer perimeter 42 of the tank 40. The flame retardant substance passes from the interior of the tank 40 through the tubes 44 when the housing portions 20,30 are in an opened position.

The lower housing portion 30 of the housing 15 has an upper edge 31, a lower end 32, and an interior. The upper edge 31 of the lower housing portion 30 forms an opening into the interior of the lower housing portion 30. The upper housing portion 20 of the housing has a lower edge 21, an upper end 22, and an interior. The lower edge 21 defines an opening into the interior of the upper housing portion 20. Preferably, each of the housing portions 20,30 is generally frusto-conical. Ideally, the diameters of each of the edges 21,31 of the housing portions 20,30 is between three and fifteen inches.

The edges 21,31 of the housing portions 20,30 are spaced apart when the housing portions 20,30 are in the opened position. The edges 21,31 of the housing portions 20,30 are positioned adjacent to each other when the housing portions 20,30 are in the closed position. Preferably, the housing portions 20,30 are biased towards the opened position.

The tank 40 is positioned between the upper edge 31 of the lower housing portion 30 and the lower edge 21 of the upper housing portion 20 such that the tubes 44 direct the flame retardant substance between the upper edge 31 of the lower housing portion 30 and the lower edge 21 of the upper housing portion 20 and out into the area outside the housing 15 when the housing portions 20,30 are in the opened position. Most preferably, the tubes 44 are elongate and are positioned such that the longitudinal axes of the tubes 44 are substantially parallel to the lower end 32 of the lower housing portion 30.

Preferably, the fire suppression device 10 further comprises a time-release mechanism 50 that permits opening of the upper and lower housing portions 20,30 after a predetermined amount of time. The time-release mechanism holds the upper and lower housing portions 20,30 in the closed position until the time-release mechanism 50 is activated.

In the preferred embodiment, the time-release mechanism 50 has a rod 51, a solenoid 57, a timer 55, a button 56, and a power supply 59. The rod 51 of the time-release mechanism 50 extends from the lower housing portion 30 towards the upper housing portion 20. The rod 51 has a bottom end 52 and a top end 53. The bottom end 52 of the rod 51 is coupled to the lower housing portion 30. The top end 53 of the rod 51 has a notch 54 in it.

The timer 55 of the time-release mechanism 50 is remotely activated by actuation of the button 56. The timer 55 is electrically coupled to the solenoid 57 and activates the solenoid 57 after a predetermined amount of time from activation of the timer 55. Ideally, the period of delay is about five to ten seconds.

The solenoid 57 of the time-release mechanism 50 is coupled to the upper housing portion 20. The solenoid 57 has a pin 58 extending from it. The pin 58 is slidably inserted in the notch 54 of the rod 51 when the housing portions 20,30 are in the closed position. The solenoid 57 removes the pin 58 from the notch 54 of the rod 51 when the solenoid 57 is activated by the timer 55, thereby permitting the housing portions 20,30 to open into the opened position. Ideally, the pin 58 is biased towards the notch 54 such that the housing portions 20,30 may be pushed towards each other into the closed position and the pin 58 snaps into the notch 54 of the rod 51 to hold the housing portions 20,30 in the closed position.

Preferably, the tank 40 is generally annular shaped and has a hole 41. In such an embodiment, the fire suppression device 10 further comprises a flanged sleeve 60. The flanged sleeve 60 is slidably disposed around the rod 51 of the time-release mechanism 50. The flanged sleeve 60 has an upper end 61 and a flanged end 61. The flanged end 61 is positioned towards the lower end 32 of the lower housing portion 30. The flanged sleeve 60 slidably extends through the hole 41 of the tank 40.

The flanged sleeve 60 is positionable between a raised position and a lowered position. The flanged sleeve 60 moves into a raised position when the housing portions 20,30 move from the closed position to the opened position.

The flanged end 61 of the flanged sleeve 60 moves the tank 40 such that the tank 40 is positioned between the upper edge 31 of the lower housing portion 30 and the lower edge 21 of the upper housing portion 20 when the flanged sleeve 60 is in the raised position and the housing portions 20,30 are in the opened position. In such a position, the outer perimeter 42 of the tank 40 is substantially exposed to the area outside the housing 15.

Ideally, the flanged sleeve 60 is biased towards a raised position. A sleeve spring 63 may be disposed between the flanged sleeve 60 and the lower end 32 of the lower housing portion to bias the flanged sleeve 60 towards the raised position. The upper end 61 of the flanged sleeve 60 abuts the pin 58 of the time-release mechanism 50 when the flanged sleeve 60 is in the lowered position. The flanged sleeve 60 moves into a raised position when the pin 58 of the time-release mechanism 50 is removed from the notch 54 of the rod 51. The upper end 61 of the flanged sleeve 60 abuts the upper end 22 of the upper housing portion 20 when the flanged sleeve 60 is in the raised position.

Preferably, the tank 40 is generally annular shaped. The tubes 44 are elongate and spaced apart and extend radially outwards from the outer perimeter 42 of the tank 40 to blow a fire away from the fire suppression device 10 in all directions or suppress a fire within a predetermined radius of the fire suppression device 10. Ideally, the longitudinal axis of each of the tubes 44 is substantially parallel the upper and lower end 22,32 of the housing portions 20,30 such that when the fire suppression device 10 is laid or thrown down and lands on one of the ends 22,32 of the housing portions 20,30, the fire retardant material will spray out substantially parallel to the surface on which one of the ends 22,32 is resting.

Preferably, each of the tubes 44 has a valve 45. Each of the valves 45 opens when the housing portions 20,30 are in the opened position to permit passage of the flame retardant substance from the tank 40 through the tubes 44. Each of the valves 45 is closed when the housing portions 20,30 are in the closed position. Ideally, the valves 45 abut a flange 23 that extends around the interior of the upper housing portion 20 parallel to the lower edge 21 of the upper housing portion 20. The flange 23 holds the valves 45 in a closed position when the housing portions 20,30 are in a closed position. The flange 23 releases the valves 45, permitting them to open, when the housing portions 20,30 are in an opened position.

Also preferably, the fire suppression device 10 further comprises a means for refilling the tank (not shown). Ideally, the tank 40 is refilled when the housing members 20,30 are in the closed position and the valves 45 of the tubes 44 are closed.

Preferably, the lower housing portion 30 of the housing 15 has a plurality of pegs 33 that extend into the interior of the upper housing portion 20. Each of the pegs 33 has a housing spring 34 that is disposed around it. Each of the housing springs 34 is disposed between the upper housing portion 20 and the lower housing portion 30 to bias the housing portions 20,30 towards the opened position. More preferably, each of the housing springs 34 has a first end 35 and a second end 36. The first ends 35 of the housing springs 34 are coupled to the lower housing portion 30. The second ends 36 of the housing springs 34 are coupled to the upper housing portion 20.

In use, the button 56 of the time-release mechanism 50 is actuated to start the timer 55. The fire suppression device 10 is placed or thrown into a fire and lands on one of the ends 22,32 of the housing portions 20,30. When a predetermined amount of time has passed, the timer 55 activates the solenoid 57. The solenoid 57 removes the pin 58 from the notch 54 of the rod 51, thereby permitting the housing members 20,30 to move into an opened position. The tank 40 is pushed by the flanged sleeve 60 to a position between the housing members 20,30 such that the flame retardant material being released from the tubes 44 sprays out and knocks down or puts out a fire within a predetermined radius from the fire suppression device 10. The fire suppression device 10 is especially effective for permitting passage through a fire-blocked doorway.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fire suppression device for suppressing a fire within a predetermined radius of the fire suppression device, said fire suppression device comprising:

a housing having upper and lower housing portions;

said lower housing portion of said housing having an upper edge, a lower end, and an interior, said upper edge forming an opening into said interior of said lower housing portion;

said upper housing portion of said housing having a lower edge, an upper end, and an interior, said lower edge defining an opening into said interior of said upper housing portion;

said housing portions being positionable between an opened position and a closed position, said edges of said housing portions being spaced apart when said housing portions are in said opened position, said edges of said housing portions being positioned adjacent to each other when said housing portions are in said closed position;

a tank for holding flame retardant substance being disposed between said housing portions, said tank having an interior and an outer perimeter;

wherein said tank is positioned between said upper edge of said lower housing portion and said lower edge of said upper housing portion when said housing portions are in said opened position;

said tank having a plurality of apertures extending therethrough into said interior of said tank, said apertures being positioned along said outer perimeter of said tank; and wherein said flame retardant substance passes from said interior of said tank through said apertures when said housing portions are in said opened position.

2. The fire suppression device of claim 1, wherein each of said apertures has a tube inserted therein, said tubes being outwardly extended from said outer perimeter of said tank, wherein said flame retardant substance passes from said interior of said tank through said tubes when said housing portions are in said opened position.

3. The fire suppression device of claim 2, wherein said tank is generally annular shaped, said tubes being elongate and extending radially outwards from said outer perimeter of said tank.

4. The fire suppression device of claim 2, wherein each of said tubes has a valve, each of said valves being opened when said housing portions are in said opened position to permit passage of said flame retardant substance from said tank through said tubes, each of said valves being closed when said housing portions are in said closed position.

5. The fire suppression device of claim 1, further comprising a time-release mechanism for permitting opening of said upper and lower housing portions after a predetermined amount of time, said housing portions being biased towards said opened position, said time-release mechanism holding said upper and lower housing portions in said closed position until said time-release mechanism is activated.

6. The fire suppression device of claim 5, wherein said time-release mechanism has a rod, a solenoid, a timer, a button, and a power supply;

wherein said rod of said time-release mechanism extending from said lower housing portion towards said upper housing portion, said rod having a bottom end and a top end, said bottom end of said rod being coupled to said lower housing portion, said top end of said rod having a notch therein;

wherein said timer of said time-release mechanism being remotely activated by actuation of said button, said timer being electrically coupled to said solenoid, said timer activating said solenoid after a predetermined amount of time from activation of said timer; and wherein said solenoid of said time-release mechanism being coupled to said upper housing portion, said solenoid having a pin extending therefrom, said pin being slidably inserted in said notch of said rod when said housing portions are in said closed position, said solenoid removing said pin from said notch of said rod when said solenoid is activated by said timer thereby permitting said housing portions to open into said opened position.

7. The fire suppression device of claim 1, further comprising a flanged sleeve, wherein said tank is generally annular shaped and has a hole, said flanged sleeve having an upper end and a flanged end, said flanged end being positioned towards said lower end of said lower housing portion, said flanged sleeve being slidably extended through said hole of said tank, said flanged sleeve being positionable between a raised position and a lowered position, said flanged sleeve moving into said raised position when said housing portions move from said closed position to said opened position.

8. The fire suppression device of claim 7, wherein said flanged end of said flanged sleeve moves said tank such that said tank is positioned between said upper edge of said lower housing portion and said lower edge of said upper housing portion when said flanged sleeve is in said raised position and said housing portions are in said opened position.

9. The fire suppression device of claim 8, wherein said flanged sleeve is biased towards said raised position.

10. The fire suppression device of claim 1, wherein said lower housing portion of said housing has a plurality of pegs being extended into said interior of said upper housing portion, each of said pegs having a housing spring being disposed therearound, each of said housing springs being disposed between said upper housing portion and said lower housing portion, said housing portions being biased towards said opened position by said housing springs.

11. A fire suppression device for suppressing a fire within a predetermined radius of the fire suppression device, said fire suppression device comprising:

a housing having upper and lower housing portions, each of said housing portions being generally frusto-conical;

said lower housing portion of said housing having an upper edge, a lower end, and an interior, said upper edge forming an opening into said interior of said lower housing portion;

said upper housing portion of said housing having a lower edge, an upper end, and an interior, said lower edge defining an opening into said interior of said upper housing portion;

said housing portions being positionable between an opened position and a closed position, said edges of said housing portions being spaced apart when said housing portions are in said opened position, said edges of said housing portions being positioned adjacent to each other when said housing portions are in said closed position;

said lower housing portion of said housing having a plurality of pegs being extended into said interior of said upper housing portion;

each of said pegs having a housing spring being disposed therearound, each of said housing springs disposed between said upper housing portion and said lower housing portion;

said housing portions being biased towards said opened position by said housing springs;

a generally annular tank for holding flame retardant substance being disposed between said housing portions, said tank having an interior, a hole, and an outer perimeter;

a time-release mechanism for permitting opening of said upper and lower housing portions after a predetermined amount of time, said time-release mechanism having a rod, a solenoid, a timer, a button, and a power supply;

said rod of said time-release mechanism extending from said lower housing portion towards said upper housing portion, said rod having a bottom end and a top end, said bottom end of said rod being coupled to said lower housing portion, said top end of said rod having a notch therein;

said timer of said time-release mechanism being remotely activated by actuation of said button, said timer being electrically coupled to said solenoid, said timer activating said solenoid after a predetermined amount of time from activation of said timer;

said solenoid of said time-release mechanism being coupled to said upper housing portion, said solenoid having a pin extending therefrom, said pin being slidably inserted in said notch of said rod when said housing portions are in said closed position, said solenoid removing said pin from said notch of said rod when said solenoid is activated by said timer thereby permitting said housing portions to open into said opened position;

a flanged sleeve being slidably disposed around said rod of said time-release mechanism, said flanged sleeve having an upper end and a flanged end, said flanged end being positioned towards said lower end of said lower housing portion, said flanged sleeve being slidably extended through said hole of said tank;

said flanged sleeve being positionable between a raised position and a lowered position, said flanged sleeve moving into said raised position when said housing portions move from said closed position to said opened position, said flanged sleeve being biased towards said raised position;

said flanged end of said flanged sleeve moving said tank such that said tank is positioned between said upper edge of said lower housing portion and said lower edge of said upper housing portion when said flanged sleeve is in said raised position and said housing portions are in said opened position;

said tank having a plurality of tubes extending therethrough from said interior of said tank, said tubes being extended radially outwards from said outer perimeter of said tank; and each of said tubes having a valve, each of said valves being opened when said housing portions are in said open position to permit passage of said flame retardant substance from said tank through said tubes, each of said valves being closed when said housing portions are in said closed position.

* * * * *